US005148225A

United States Patent [19]

Takeda et al.

[11] Patent Number: 5,148,225

[45] Date of Patent: Sep. 15, 1992

[54] ELECTROPHOTOGRAPHIC PROCESS AND APPARATUS

[75] Inventors: Takayuki Takeda; Shinichi Itoh, both of Tokyo, Japan

[73] Assignee: Oki Electric Industry Co., Ltd., Tokyo, Japan

[21] Appl. No.: 722,215

[22] Filed: Jun. 27, 1991

[30] Foreign Application Priority Data

Jul. 3, 1990 [JP] Japan ..... 2-174387

[51] Int. Cl.[5] ..... G03G 15/00

[52] U.S. Cl. ..... 355/272; 355/210

[58] Field of Search ..... 355/210, 211, 212, 213, 355/200, 77, 272; 430/54

[56] References Cited

U.S. PATENT DOCUMENTS

| | | | |
|---|---|---|---|
| 2,576,047 | 11/1951 | Schaffert . | |
| 3,615,128 | 10/1971 | Bhagat . | |
| 3,697,160 | 10/1972 | Clark . | |
| 3,722,992 | 3/1973 | Zweig . | |
| 3,738,855 | 6/1973 | Gundlach | 430/54 |
| 3,778,841 | 12/1973 | Gundlach et al. . | |
| 3,820,985 | 6/1974 | Gaynor et al. . | |
| 3,937,572 | 2/1976 | Gaynor et al. . | |
| 4,021,106 | 5/1977 | Gaynor . | |
| 4,025,188 | 5/1977 | Radler et al. . | |

*Primary Examiner*—R. L. Moses

*Attorney, Agent, or Firm*—Spencer, Frank & Schneider

[57] ABSTRACT

In electrophotographic process and apparatus of this invention, a drum-like photosensitive member and an endless toner-image bearing member are used. The bearing member is brought into close contact at a part thereof with the sensitive member. The sensitive member is electrically charged. After the bearing member is brought into close contact with the sensitive member, a latent image is formed on the sensitive member. The latent image is developed from an outer side of the bearing member so that a toner image is formed on its surface. To perform ordinary printing, the toner image is transferred onto a support member and then fixed. To conduct printing of multiple copies by using a master, the toner image on the bearing member is fused first to form a master, followed successively by electrical charging of the sensitive member, close contact of the master with the sensitive member, and whole-surface exposure from an outer side of the master. A latent image is formed on the sensitive member. Development of the latent image forms a toner image on the master, which is transferred onto a support member and then fixed.

7 Claims, 7 Drawing Sheets

ELECTROPHOTOGRAPHIC PROCESS AND APPARATUS

BACKGROUND OF THE INVENTION

1) Field of the Invention

The present invention relates to an electrophotographic process suitable for use in recording apparatuses such as printers and copying machines and also to an electrophotographic apparatus thereof.

2) Description of the Related Art

According to conventional electrophotography, an electrostatic latent image is formed on a photosensitive member, namely, on an electrostatic latent-image bearing member, the electrostatic latent image is developed to form a toner image, and the toner image is then transferred onto a support sheet, namely, onto a support member. This process is widely used in copying machines, printers and the like as it can provide records of high picture quality.

In general, an electrophotographic apparatus permitting high-speed recording is large and expensive and consumes large amounts of power. Users are therefore required to employ an electrophotographic apparatus or a printing machine by selecting either one of these depending on the number of copies to be made from the same original. This selection is certainly cumbersome to them.

When prints as few as several sheets are desired, it is preferred to make them by simply using an electrophotographic apparatus. On the other hand, in cases where several hundred or more copies are required, printing by a printing machine such as a stencil printing apparatus, a screen printing apparatus or an offset printing apparatus is preferred. For prints or copies where the number required falls between the two quantities described above, neither the electrophotographic apparatus nor the printing machine can fully satisfy the user's needs due to printing cost, printing time or the like.

An apparatus has hence been provided, which is usually employed as an electrophotographic apparatus but, when a large number of copies is needed, a toner image is first fused on a photosensitive member to prepare a master, the photosensitive member is next electrically charged through the toner image on the master while making use of light-shielding effects of the toner image, the thus-charged photosensitive member is then subjected to whole-surface exposure to promptly form an electrostatic latent image without scanning the original, and copies are then obtained (See Schaffert U.S. Pat. No. 2,576,047 issued Nov. 20, 1951; The 4th Symposium on Non-impact Printing Technology, "Xerography technology", pp 113–116).

Conventional electrophotographic processes and apparatuses however involve the problems that a photosensitive member with a toner image fused thereon cannot be reused and must be thrown away after completion of printing.

To overcome these problems, an apparatus has been provided. In this apparatus, a supply roller with a photosensitive sheet of a length equivalent to about 100 frames or so wound thereon and a take-up roller for winding up the photosensitive sheet after use are disposed within a drum so that the photosensitive sheet can be automatically supplied onto the drum.

However, the above apparatus has a complex construction and, depending on the manner of use, the photosensitive sheet inside the drum may have to be replaced frequently, resulting in a higher printing cost. In addition, the toner on the photosensitive member is heated directly so that the photosensitive member deteriorates and the potential charged on the photosensitive member thus varies. Further, the photosensitive member is electrically charged through the toner image so that the potential charged on the photosensitive member locally varies depending on the presence or absence of the toner image, thus causing a deterioration in the quality of the resulting picture.

SUMMARY OF THE INVENTION

An object of the present invention is to provide an electrophotographic recording process and apparatus, which permits repeated use of a master without disposal so that an increase in printing cost can be avoided regardless of the number of print(s) to be made.

According to the electrophotographic process and apparatus of this invention, an electrostatic latent-image bearing member and a light-transmitting, toner-image bearing member are provided. The toner-image bearing member passes around each of the electrostatic latent-image bearing member and a roller, and is brought into close contact at a part thereof with the electrostatic latent-image bearing member. A surface of the electrostatic latent-image bearing member is electrically charged by an electrical charging means arranged in a direct opposing relationship with the electrostatic latent-image bearing member.

A data exposure means is also provided either inside or outside the toner-image bearing member, whereby the surface of the electrostatic latent-image bearing member is exposed to light corresponding to information on a picture to be recorded to form an electrostatic latent image.

The electrostatic latent image is developed by a developing means from an outer side of the light-transmitting, toner-image bearing member, so that a toner image corresponding to the electrostatic latent image is formed.

When ordinary printing which does not use any master is conducted, the toner image is transferred onto a support member by a transfer means and then fixed by a fixing means.

On the other hand, when printing of multiple copies of the same picture is conducted by using a master, the toner image is fused by a toner image fusing means arranged at a station where the toner-image bearing member is apart from the electrostatic latent-image bearing member, thereby forming a master.

Subsequently, the electrostatic latent-image bearing member is electrically charged by the charging means, the master is brought into close contact with the electrostatic latent-image bearing member, and the electrostatic latent-image bearing member is subjected to whole-surface exposure from an outer side of the master. By this whole-surface exposure, an electrostatic latent image corresponding to the fused toner image is formed on the surface of the electrostatic latent-image bearing member.

Development of the electrostatic latent image results in the formation of a toner image on the surface of the master. The toner image is then transferred onto the support member by the transfer means and then fixed by the fixing means.

DESCRIPTION OF THE PREFERRED EMBODIMENTS

Embodiments of the present invention will hereinafter be described in detail with reference to the accompanying drawings.

The first embodiment of the present invention will be described with reference to FIG. 1 through FIG. 4E.

Figure 1:
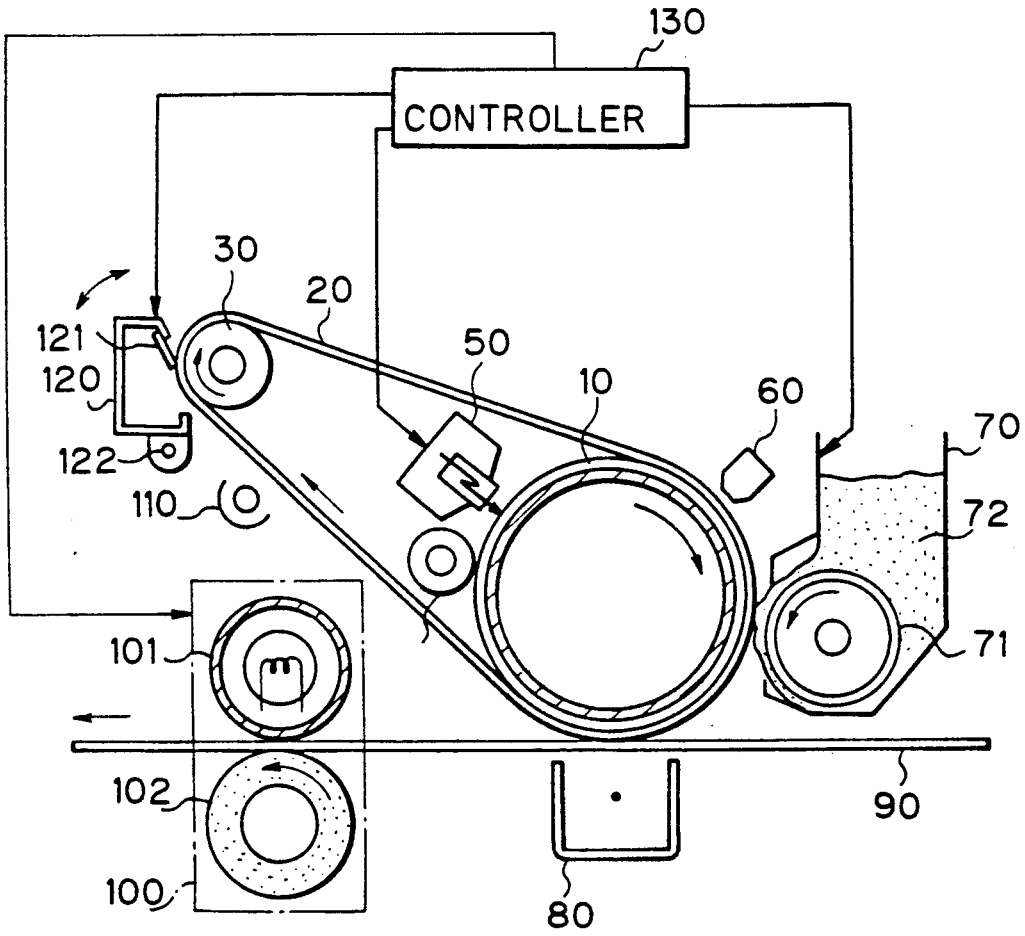
FIG. 1 is a diagrammatic view of the construction of an electrophotographic apparatus, showing a first embodiment of the present invention.

FIG. 1 is a diagrammatic view of the construction of the electrophotographic apparatus according to the first embodiment.

The illustrated electrophotographic apparatus has an electrostatic latent-image bearing member 10 formed in a drum-like shape and mounted for rotation on an unillustrated frame. The electrostatic latent-image bearing member 10 can be rotated by a motor (not shown) at a constant speed in the direction indicated by the arrow.

The electrostatic latent-image bearing member 10 includes a photoconductive layer 12 on an electrically conducting support 11. Usable examples of the electrostatic latent-image bearing member include a selenium photosensitive member, an organic photosensitive member, a zinc oxide photosensitive member, an amorphous silicon photosensitive member, and the like. In the illustrated embodiment, an organic photosensitive member of the negative charge type is used, which includes the photoconductive layer 12 formed of a charge generating layer and a charge transport layer stacked on the electrically conducting support 11 in the order that they are presented.

An endless, toner-image bearing member 20 passes around each of the electrostatic latent-image bearing member 10 and a roller 30. The toner-image bearing member 20 is superposed on the electrostatic latent-image bearing member 10 so that the toner-image bearing member 20 can be brought into close contact at a part thereof with the electrostatic latent-image bearing member 10. As the electrostatic latent-image bearing member 10 rotates, the toner-image bearing member 20 is driven at the same speed.

An electrical charging device 40 as an electrical charging means is constructed of an electrically conducting metal shaft connected to a high-voltage power supply and an electrically conducting rubber coated on the metal shaft. The electrical charging device 40 is arranged in a direct opposing relationship with a surface of the electrostatic latent-image bearing member 10. As the charging device 40, a brush charger, a corona charger or the like can be used instead of the roller charging device shown in the drawing.

A data exposure device 50 irradiates, onto the electrostatic latent-image bearing member 10, light which corresponds to information on a picture to be recorded. As the data exposure device 50, a combination of a linear light source and a liquid crystal shutter or a similar data exposure device can be used in addition to a combination of an LED array and a "SELFOC" (trade mark) lens. In the illustrated embodiment, electrical signals corresponding to an optical image are fed by a controller 130. The controller 130 also performs entire control of the apparatus.

A whole-surface exposure device 60 is constructed of a linear light source such as a fluorescent lamp or the like, and is arranged so that the electrostatic latent-image bearing member 10 can be exposed to light via the toner-image bearing member 20 while the electrostatic latent-image bearing member 10 and the toner-image bearing member 20 are maintained in close contact with each other.

A developing device 70 as a developing means adsorbs toner 72 on a toner support 71 and transports it in the direction indicated by the arrow. Through the toner-image bearing member 20, the toner 72 develops the electrostatic latent image formed on the electrostatic latent-image bearing member 10 so that a corresponding toner image is formed on a surface of the toner-image bearing member 20. Usable examples of the developing device include a two-component magnetic brush developing device, a single-component magnetic brush developing device, a single-component non-magnetic developing device, and the like.

A transfer device 80 as a transfer means serves to transfer the toner image from the toner-image bearing member 20 onto a support member 90. Usable examples of the transfer device 80 include, in addition to the corona charger shown in the drawing, a transfer device capable of performing electrostatic transfer by using an electrically conducting roller or a transfer device of the adhesion type.

A fixing device 100 is adapted to fix a toner image formed on the support member 90. Usable examples of the fixing device 100 include a pressure fixing device or the like besides the illustrated heat-roll fixing device composed of a heating roller 101 and a pressure roller 102.

A flash lamp 110 serves to heat and fuse a toner image formed on the toner-image bearing member 20.

A cleaning device 120 carries a blade 121 at a free end thereof and is supported about a pin 122 pivotally in the direction indicated by the arrow. The cleaning device 120 is hence constructed so that a free end of the blade 121 is movable to and away from the toner-image bearing member 20.

These operations are controlled by the controller 130.

Operation and effects of the electrophotographic apparatus of the above-described construction will be described hereinafter.

In the apparatus, an image can be formed on the support member 90 by either one of two image formation processes to be described below.

First of all, the first image formation process will be described with reference to FIG. 2A through FIG. 2E.

Figure 2A:
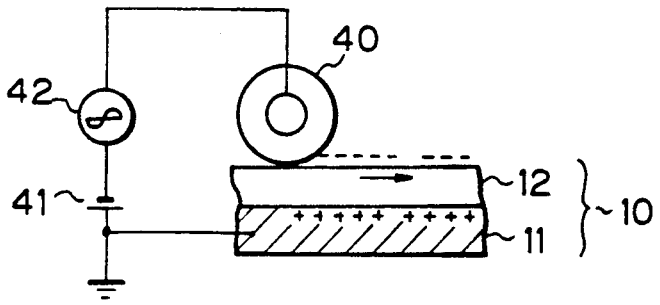
FIG. 2A through FIG. 2E show various steps of a first image formation process making use of the electrophotographic apparatus of FIG. 1.
Figure 2B:
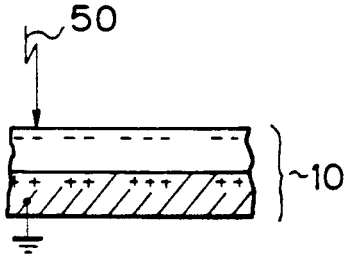
Figure 2C:
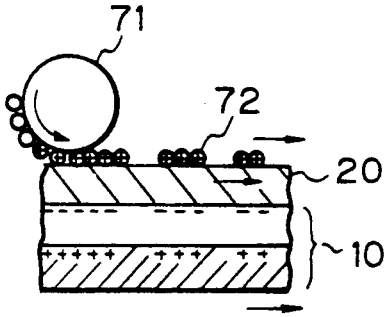
Figure 2D:
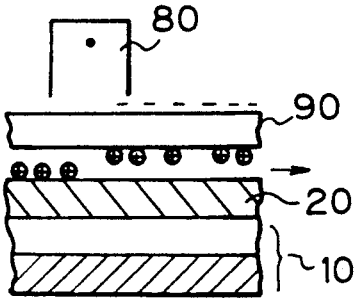
Figure 2E:
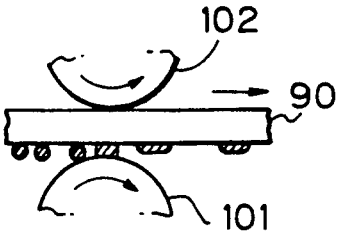

FIG. 2A illustrates an electrical charging step, FIG. 2B a data exposure step, FIG. 2C a developing step, FIG. 2D a transfer step, and FIG. 2E a fixing step.

In the electrical charging step (FIG. 2A), the electrostatic latent-image bearing member 10 is electrically and evenly charged by the electrical charging device 40 which is connected to a DC power supply 41 and an AC power supply 42. The electrostatic latent-image bearing member 10 has the photoconductive layer 12 coated on the electrically conducting member 11 as shown in the drawing. Namely, the organic photosensitive member of the negative charge type is used in this embodiment. When a high voltage is applied to the charging device 40, the photoconductive layer 12 is therefore charged in negative. Since a surface of the electrostatic latent-image bearing member 10 is subjected to direct electrical charging in this charging process, the surface of the electrostatic latent-image bearing member 10 can be always electrically and evenly charged irrespective of the presence or absence of a toner image on a corresponding surface of the toner-image bearing member 20.

In the data exposure step (FIG. 2B), the data exposure device 50 irradiate light, which corresponds to image signals, onto the electrostatic latent-image bearing member 10, whereby an electrostatic latent image is formed on the photoconductive layer 12. After completion of the data exposure step, the toner-image bearing member 20 is brought into close contact with the electrostatic latent-image bearing member 10 on which the electrostatic latent image has been formed.

In the developing step (FIG. 2C), development is performed by the developing device 70 which is disposed in the outer proximity of the toner-image bearing member 20 maintained in close contact with the electrostatic latent-image bearing member 10. In the illustrated embodiment, normal development is conducted. The toner 72 charged is positive on the toner support 71 adheres on the toner-image bearing member 20 by an electrostatic force so that a toner image corresponding to the electrostatic latent image is formed. Incidentally, the toner support 71 can be connected to a bias power supply as needed.

Since the electrostatic latent-image bearing member 10 and toner do not undergo any direct contact in the developing step of the present invention as described above, no toner-filming phenomenon occurs on the electrostatic latent-image bearing member 10 so that the electrostatic latent-image bearing member 10 is assured to enjoy prolonged service life.

After the development, the support member 90 is conveyed by an unillustrated paper feeding means and is brought into a superposed, contiguous relationship with the toner-image bearing member 20. Here, charges of polarity opposite to the polarity of charges on the toner 72 are applied to the back side of the support member 90 by the transfer device 80. By the charges so applied, the toner image on the toner-image bearing member 20 is attracted and transferred onto the support member 90 (see FIG. 2D).

The support member 90 with the toner image transferred thereon is fed to the fixing device, so that the toner image is fixed. Namely, the toner is fused by heat applied from the heating roller 101 through the support member 90. The toner so fused is caused to penetrate between fibers of the support member 90 under the pressure applied from the pressure roller 102. The support member 90 with the toner image fixed therein is fed out of the apparatus.

Although a little toner still remains on the toner-image bearing member 20 even after the transfer, the remaining toner is transported, as it is, to the developing device because the blade 121 of the cleaning device 120 is separated from the toner-image bearing member 20. The remaining toner is hence cleaned off concurrently with the next development. Remaining toner can therefore be reused without recovering it outside the apparatus. It is to be noted that no remaining toner is present on the electrostatic latent-image bearing member 10 and neither electrical charging by the electrical charging device 40 nor exposure by the data exposure device 50 is hampered or otherwise obstructed by such remaining toner.

A description will next be made of a process for forming a master by fusing a toner image on the toner-image bearing member 20 and the second image formation process making use of the master.

FIG. 3A through FIG. 3D diagrammatically illustrate the master formation process which is practiced by using the electrophotographic apparatus of the present invention.

Figure 3A:
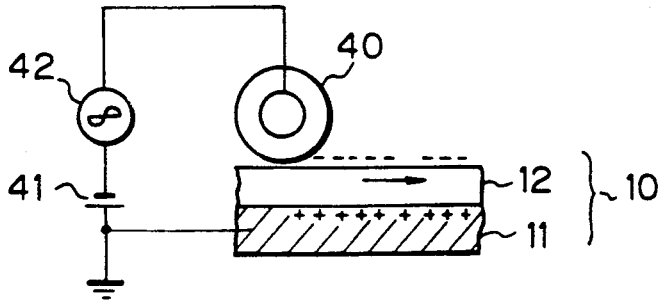
FIG. 3A through FIG. 3D illustrate various steps of a master formation process making use of the electrophotographic apparatus of FIG. 1.
Figure 3B:
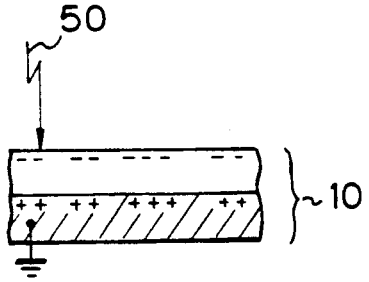
Figure 3C:
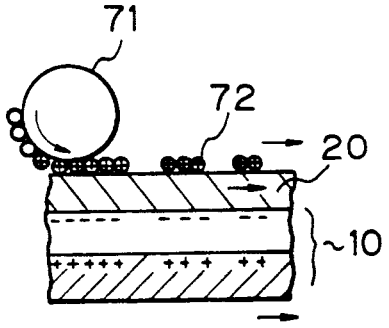
Figure 3D:
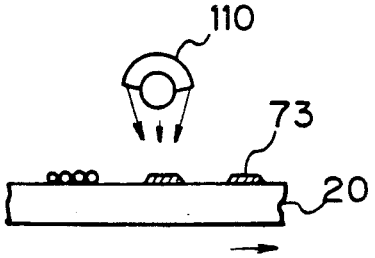

FIG. 3A shows an electrical charging step, FIG. 3B a data exposure step, FIG. 3C a developing step and FIG. 3D a fusing step.

In the individual steps shown in FIG. 3A through FIG. 3C respectively, electrical charging, data exposure and development are performed as in the first image formation process. After the development, the toner-image bearing member 20 with the toner image formed thereon is driven. When the toner image is fed to a station remote from the electrostatic latent-image bearing member 10, the toner image is heated by the flash lamp 110 so that the toner image is fused on the toner-image bearing member 20 (see FIG. 3D).

Since the fusion of the toner image onto the toner-image bearing member 20 is carried out at the state remote from the electrostatic latent-image bearing member 10 as described above, the electrostatic latent-image bearing member 10 can be protected from thermal deterioration.

In the above-described master forming process, it is necessary to pay attention so that the toner image on the toner-image bearing member 20 is not disturbed by the transfer device 80 in the course of its travelling from the developing step (FIG. 3C) to the fusing step (FIG. 3D). The transfer device 80 must be kept apart from the toner-image bearing member 20 especially when a pressure contacting means such as an electrically conducting roller is used as the transfer device 80. Likewise, the blade 121 of the cleaning device 120 is also maintained apart from the toner-image bearing member 20 so that the blade 121 would contact neither the toner-image bearing member 20 nor a fused toner image 73.

Figure 4A:
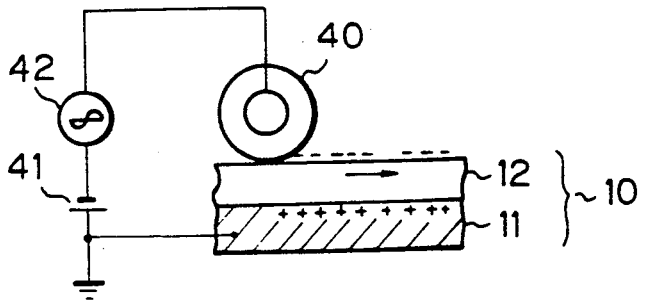
FIG. 4A through FIG. 4E depict various steps of a second image formation process making use of the electrophotographic apparatus of FIG. 1.

FIG. 4A through FIG. 4E illustrates the second image formation process which is practiced by the electrophotographic apparatus of this invention. FIG. 4A depicts an electrical charging step, FIG. 4B an exposure step, FIG. 4C a developing step, FIG. 4D a transfer step, and FIG. 4E a fixing step.

As is illustrated in FIG. 4A, an electrical charging step similar to that (FIG. 2A) of the first image formation process is performed in the second image formation process.

After completion of the electrical charging step, the toner-image bearing member 20 with a toner image fused thereon is brought into close contact with the electrostatic latent-image bearing member 10 which has been electrically charged in negative.

In the exposure process (FIG. 4B), the whole-surface exposure device 60 irradiates light onto the electrostatic latent image bearing member 10 through the toner-image bearing member 20. Since the light is partially shielded or blocked by the fused toner image 73, an electrostatic latent image corresponding to the fused toner image 73 is formed on the electrostatic latent-image bearing member 10.

In the developing step (FIG. 4C), normal development is conducted in a manner similar to FIG. 2C, so that the toner 72 charged in positive on the toner support 71 is caused to adhere by an electrostatic force onto the fused toner image 73 on the toner-image bearing member 20 to conduct development.

After the development, the support member 90 is brought into a superposed, contiguous relationship with the toner-image bearing member 20 by an unillustrated paper feeding means. Here, the transfer device 80 applies charges of polarity opposite to that of charges on the toner 72 to the back side of the support member 90. As a result, the toner image on the toner-image bearing member 20 is transferred onto the support member 90 (FIG. 4D). The fused toner image 73 remains on the toner-image bearing member 20 because its adhesion to the toner-image bearing member 20 is greater than the electrostatic force applied upon transfer.

The toner image on the support member 90 is fixed by a step (FIG. 4E) similar to the step shown in FIG. 2E and is then fed out of the apparatus.

On the other hand, the fused toner image 73 still remains as it is on the toner-image bearing member 20 after the transfer. Provided that the cleaning device is maintained apart from the toner-image bearing member 20, a desire number of prints can be obtained by repeating the electrical charging, exposure, developing, transfer and fixing steps described above.

After completion of the desired number of prints, the blade 121 of the cleaning device 120 is brought into contact under pressure with the toner-image bearing member 20 so that the fused toner image is scraped off. Therefore, the toner-image bearing member 20 can be reused not only in the first image formation process but also in the second image formation process which is conducted subsequent to the above-describe master formation process.

The toner-image bearing member 20 employed in this invention is desirably in the form of an electrically insulating film of 100 μm or less in thickness in view of the electrostatic force produced between the electrostatic latent-image bearing member 10 and the toner 72 upon development. Its thickness is desirably at least 5 μm in view of its tensile strength and handling. Further, it is required to have heat resistance capable of withstanding temperatures of 150°–180° C. or higher because the toner image is heated and fused in the master formation process. A still further requirement is that its surface must be smooth to facilitate the removal of the fused toner image 73 by the blade 121. To meet all the above requirements, a heat resistant plastic film made of a polyester or a polyimide is suitable as the toner-image bearing member 20.

Generally, the surface of a plastic film is extremely smooth. Use of a metal blade as the blade 121 therefore permits complete removal of the toner image 73 fused on the toner-image bearing member 20. If non-sticking property is imparted to the surface of the toner-image bearing member 20 by coating the surface with a thin film of a silicon resin or a fluorinated resin, the blade 121 is not limited to a metal blade but a rubber blade or the like can be used instead. Moreover, the force under which the blade is pressed against the toner-image bearing member 20 can be reduced. Although the bonding force between the toner-image bearing member 20 and the fused toner image 73 is lowered in this case, the bonding force is still sufficient compared to electrostatic forces applied during the developing and transfer steps.

It is desirous to choose either one of the above-described two image formation processes in accordance with the number of copies to be printed. The first image formation process is recommended when only a single copy is printed or different pictures are desired. When multiple copies of the same image are desired, it is preferable to use the second image formation process which is preceded by the master formation process. Since no data processing is required for exposure in the second image formation process, the speed of the process can be increased, thereby making it possible to conduct high-speed recording. The printing time can therefore be shortened substantially when many copies are printed.

In the embodiment described above, the apparatus was described by using it for normal development. Reversal development can also be performed. In this case, the area of each image to be recorded is exposed by the data exposure device in the first image formation process but the background of the image is exposed in the master formation process to form a reversed white/-black image. In the second image formation process, the portions other than the fused toner image 73, namely, the image are to be recorded is therefore developed in the second image formation process so that the desired, recorded image can be obtained.

It is also possible to irradiate by the data exposure device only the area of each image to be recorded in both the first image formation process and the master formation process. In this case, it is necessary to conduct reversal development in both the first image formation process and the master formation process and to perform normal development in the second image formation process. The bias power supply to be connected to the toner support 71 is therefore switched over.

Figure 5:
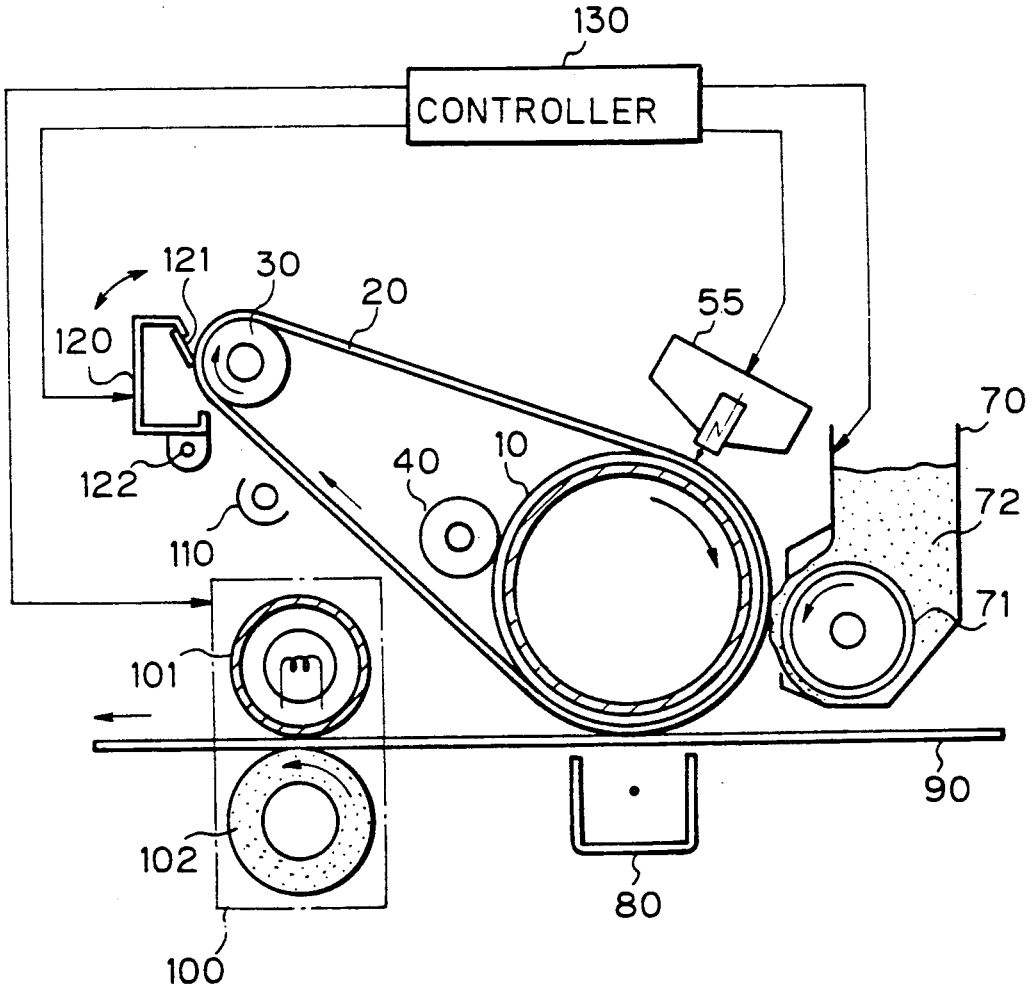
FIG. 5 is a diagrammatic view of the construction of an electrophotographic apparatus, illustrating a second embodiment of the present invention.

The second embodiment of the present invention will next be described with reference to FIG. 5, in which like reference numerals to those shown in FIG. 1 indicate like elements of structure and description of such elements is omitted herein.

Instead of the data exposure device 50 and the whole-surface exposure device 60 in FIG. only one exposure device 55 is arranged in the second embodiment at the position of the whole-surface exposure device 60.

The exposure device 55 is controlled by the controller 130 so that light corresponding to image signals is irradiated through the toner-image bearing member 20 upon data exposure in each of the first image formation process and the master formation process but light corresponding to all pixels is irradiated upon whole-surface exposure in the second image formation process.

In the second embodiment, toner still remaining on the toner-image bearing member 20 after the first image formation process hampers or otherwise obstruct the exposure in the second image formation process. It is therefore necessary to bring the blade 121 of the cleaning device 120 into contact under pressure with the toner-image bearing member 20 so that the toner still remaining the toner-image bearing member 20 after the transfer can be eliminated.

In both the first and second embodiments, the flash lamp 110 is used to fuse a toner image on the toner-image bearing member 20. The toner image fixing means is however not limited to it. For example, the toner image can be heated from the back side of the toner-image bearing member 20 by using as the roller 30 a heating roller which is similar to the heating roller 101. The toner image can also be fixed on the toner-image bearing member 20 by providing a pressure roller in adjacent to the roller 30 with the toner-image bearing member 20 interposed therebetween and pressing against the roller 30 the toner-image bearing member 20 and the toner image carried thereon.

The third embodiment of the present invention will next be described with reference to FIG. 6 through FIG. 9.

In the third embodiment, a switching means 81 is connected to the transfer device 80 so that either a DC power supply 82 or an AC power supply 83 is connected.

Figure 6:
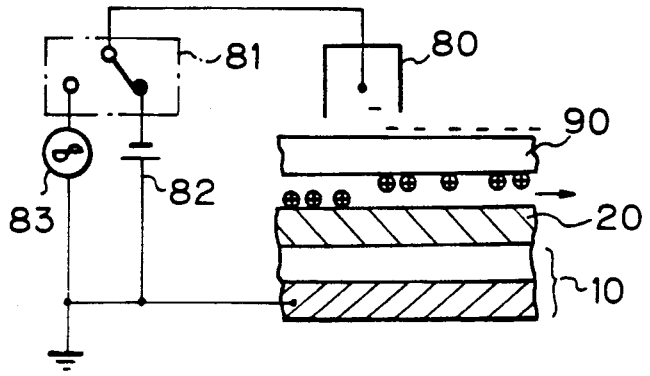
FIG. 6 diagrammatically shows a transfer step in the first image formation process in a third embodiment of the present invention.
Figure 7:
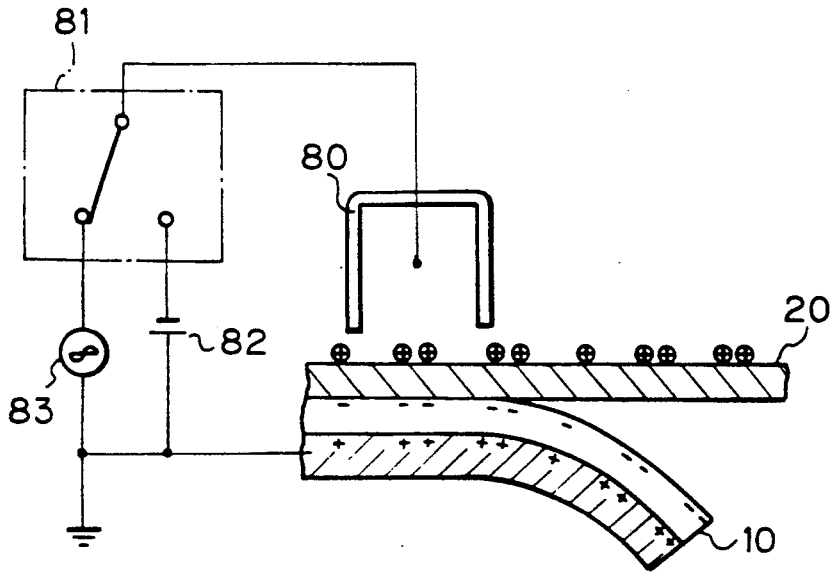
FIG. 7 diagrammatically depicts an AC discharge process which is applied upon separation of a toner-image bearing member and an electrostatic latent-image bearing member from each other in a master formation process in the third embodiment.
Figure 8A:
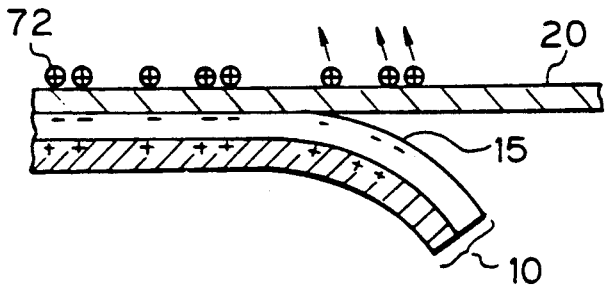
FIG. 8A and FIG. 8B are schematic illustrations of the AC discharge process in the third embodiment.
Figure 8B:
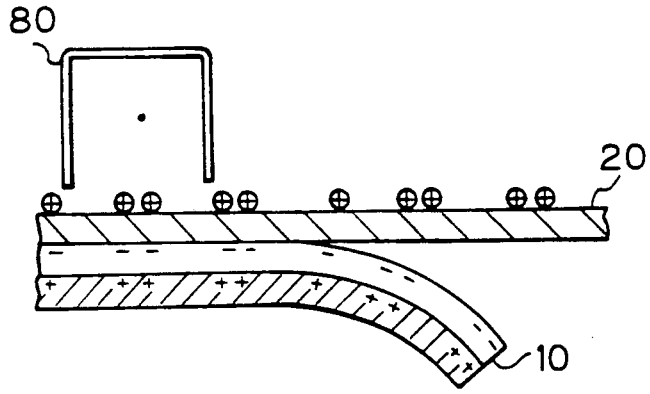
Figure 9:
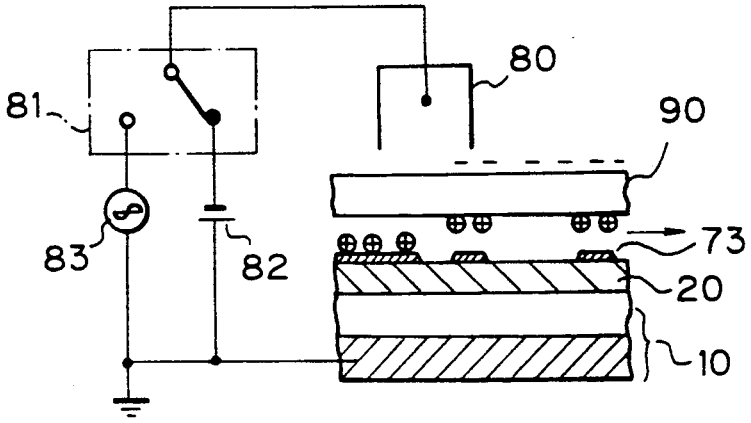
FIG. 9 diagrammatically illustrates a transfer step of the second image formation in the third embodiment.

FIG. 6 illustrates the transfer step of the first image formation process in the third embodiment. FIG. 7 illustrates an AC discharge step upon separation of the toner-image bearing member 20 and the electrostatic latent-image bearing member 10 in the master formation process. FIG. 8A and FIG. 8B diagrammatically illustrate the AC discharge step in detail, in which FIG. 8A shows the transfer device in an inoperative state while FIG. 8B depicts the transfer device in an operative state. FIG. 9 shows the transfer step of the second image formation process.

As is shown in FIG. 6, the switching means 81 is connected to the transfer device 80 so that either the DC power supply 82 or the AC power supply can be selected by the switching means 1.

In the first image formation process, subsequent to completion of electrical charging, data exposure and developing steps as in FIG. 2A through FIG. 2C, the DC power supply 82 is connected as depicted in FIG. 6, followed by transfer. A fixing step is then conducted as in FIG. 2E.

In the master formation process, after completion of electrical charging, data exposure and developing steps as in FIG. 3A through FIG. 3C, the AC power supply 83 is connected to the transfer device 80 by the switching means 81 to perform so-called AC discharge, whereby the electrostatic latent-image bearing member 10 and the toner-image bearing member 20 are separated from each other. The toner image on the toner-image bearing member 20 is thereafter heated and fused by the flash lamp so that a master is provided. This fusing step is similar to that shown in FIG. 3D.

The AC discharge described above can be performed as a countermeasure if toner images on the toner-image bearing member 20 are disturbed.

This AC discharge step will now be described in detail with reference to FIG. 8A and FIG. 8B.

During the master formation process, the transfer device 80 is maintained in an inoperative state. After development is performed in the state that the electrostatic latent-image bearing member 10 and the toner-image bearing member 20 are maintained in close contact with each other, the toner of the resulting toner image on the toner-image bearing member 20 may be scattered as shown in FIG. 8A when the toner-image bearing member 20 separates from the electrostatic latent-image bearing member 10. This could result in a disturbance of the toner image.

This problem can be attributed to the mechanism that, as the toner-image bearing member 20 separates from the electrostatic latent-image bearing member 10, the capacitance of an air layer 15 between the member 20 and the member 10 becomes smaller and the voltage applied across the air layer increases to produce a discharge.

To prevent this phenomenon, AC discharge is performed by the transfer device 80 as shown in FIG. 8B so that the electrostatic latent-image bearing member 10 and the toner-image bearing member 20 are separated from each other while eliminating charges from the surface of the toner-image bearing member 20. As a result, the voltage applied across the air layer 15, said voltage tending to increase as the capacitance of the air layer 15 drops as the members 10 and 20 are separated from each other, is prevented from increasing so that production of a discharge can be prevented.

The transfer device 80 employed here may be either a corotron charger or a scorotron charger.

Figure 4B:
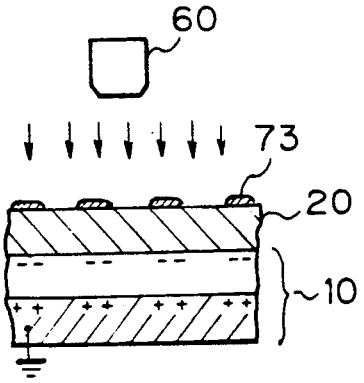
Figure 4C:
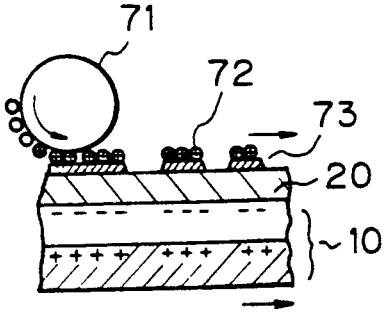
Figure 4D:
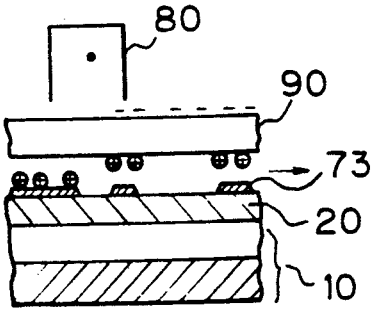
Figure 4E:
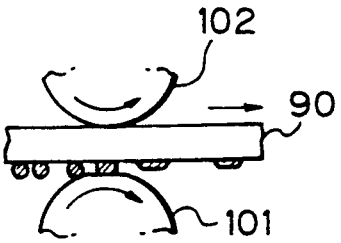

In the second image formation process of the third embodiment, after steps identical to those shown in FIG. 4A to FIG. 4C are successively carried out, the power supply connected to the transfer device 80 is changed over from the AC power supply 83 to the DC power supply 82 as shown in FIG. 9 and transfer is then performed. Thereafter, the toner image on the support member 90 is fixed in the same step as that shown in FIG. 4E.

The present invention is not limited to the embodiments described above. A variety of changes or modifications is feasible based on the principle of the present invention. These changes or modifications shall not be placed outside the breadth of the present invention.

What is claimed is:

1. An electrophotographic process comprising the following consecutive steps:

electrically charging an electrostatic latent-image bearing member;

exposing a surface of the electrostatic latent-image bearing member to light corresponding to image information to be recorded, whereby an electrostatic latent image is formed on the surface of the electrostatic latent-image bearing member;

developing the electrostatic latent image from an outer side of a transparent, toner-image bearing member arranged in close contact with the electrostatic latent-image bearing member so that a toner image corresponding to the electrostatic latent image is formed on the toner-image bearing member;

fusing the toner image at a station where the toner-image bearing member is apart from the electrostatic latent-image bearing member, thereby forming a master;

electrically charging the electrostatic latent-image bearing member again;

bringing the master into close contact with the electrostatic latent-image bearing member and subjecting the electrostatic latent-image bearing member to full-surface exposure from an outer side of the master, whereby an electrostatic latent image corresponding to the fused toner image is formed on the surface of the electrostatic latent-image bearing member;

developing the last-mentioned electrostatic latent image from the outer side of the master to form, on the master, a toner image corresponding to the fused toner image; and transferring the toner image from the master onto a support member and then fixing the toner image so transferred.

2. An electrophotographic apparatus comprising:

an electrostatic latent-image bearing member;

a light-transmitting, toner-image bearing member passing around each of the electrostatic latent-image bearing member and a roller, said toner-image bearing member being brought at a part thereof into close contact with the electrostatic latent-image bearing member;

a means for electrically charging a surface of the electrostatic latent-image bearing member, said charging means being arranged in a direct opposing relationship with the electrostatic latent-image bearing member;

a data exposure means for irradiating light corresponding to image information to be recorded, so that an electrostatic latent image is formed on the electrostatic latent-image bearing member;

a means for developing the electrostatic latent image from an outer side of the toner-image bearing member, whereby a toner image corresponding to the electrostatic latent image is formed;

a means for fusing the toner image at a station where the toner-image bearing member is apart from the electrostatic latent-image bearing member, thereby forming a master;

a cleaning means for removing at least the fused toner image, said cleaning means being arranged movably to and away from the toner-image bearing member;

a whole-surface exposure means for exposing the electrostatic latent-image bearing member to light through the master;

a means for transferring a toner image, which has been formed on a surface of the master, onto a support member; and a means for fixing the toner image transferred on the support member.

3. The electrophotographic apparatus of claim 2, wherein the transfer means comprises a corona discharge device and a switching means for selectively connecting the corona discharge device to one of a DC power supply and an AC power supply.

4. The electrophotographic apparatus of claim 3, wherein the switching means is controlled so that the corona discharge device is connected to the DC power supply upon transfer of the toner image onto the support member but to the AC power supply upon fusion of the toner image to the toner-image bearing member.

5. An electrophotographic apparatus comprising:

an electrostatic latent-image bearing member;

a light-transmitting, toner-image bearing member passing around each of the electrostatic latent-image bearing member and a roller, said toner-image bearing member being brought at a part thereof into close contact with the electrostatic latent-image bearing member;

a means for electrically charging a surface of the electrostatic latent-image bearing member, said charging means being arranged in a direct opposing relationship with the electrostatic latent-image bearing member;

a data exposure means for irradiating light corresponding to image information to be recorded, so that an electrostatic latent image is formed on the electrostatic latent-image bearing member;

a means for developing the electrostatic latent image from an outer side of the toner-image bearing member, whereby a toner image corresponding to the electrostatic latent image is formed;

a means for transferring the toner image onto a support member;

a means for fusing the toner image, which has been formed on the surface of the toner-image bearing member, to form a fused toner image as a master, said toner-image fusing means being arranged at a station where the toner-image bearing member is apart from the electrostatic latent-image bearing member;

a cleaning means for removing at least the fused toner image, said cleaning means being arranged movably to and away from the toner-image bearing member;

a whole-surface exposure means for exposing the electrostatic latent-image bearing member to light through the master; and a means for fixing the toner image transferred on the support member, wherein the transfer means is operated selectively so that the toner image on the toner-image bearing member is fed to the fixing means without transfer when the master is formed but otherwise is transferred onto the support member.

6. The electrophotographic apparatus of claim 5, wherein the transfer means comprises a corona discharge device and a switching means for selectively connecting the corona discharge device to one of a DC power supply and an AC power supply.

7. The electrophotographic apparatus of claim 6, wherein the switching means is controlled so that the corona discharge device is connected to the DC power supply upon transfer of the toner image onto the support member but to the AC power supply upon fusion of the toner image to the toner-image bearing member.

* * * * *